US010912440B2

(12) United States Patent
Yoon et al.

(10) Patent No.: US 10,912,440 B2
(45) Date of Patent: Feb. 9, 2021

(54) DISHWASHER

(71) Applicant: LG Electronics Inc., Seoul (KR)

(72) Inventors: Sangheon Yoon, Seoul (KR); Gapsu Shin, Seoul (KR); Taehee Lee, Seoul (KR); Joonho Pyo, Seoul (KR)

(73) Assignee: LG Electronics Inc., Seoul (KR)

( * ) Notice: Subject to any disclaimer, the term of this patent is extended or adjusted under 35 U.S.C. 154(b) by 226 days.

(21) Appl. No.: 15/877,778

(22) Filed: Jan. 23, 2018

(65) Prior Publication Data

US 2018/0206696 A1 Jul. 26, 2018

(30) Foreign Application Priority Data

Jan. 26, 2017 (KR) ..... 10-2017-0013007

(51) Int. Cl.
*A47L 15/08* (2006.01)
*A47L 15/00* (2006.01)
*A47L 15/42* (2006.01)

(52) U.S. Cl.
CPC ..... *A47L 15/08* (2013.01); *A47L 15/0015* (2013.01); *A47L 15/0052* (2013.01);
(Continued)

(58) Field of Classification Search
CPC ..... A47L 15/4234; A47L 15/0052; A47L 15/4221; A47L 15/4225; A47L 15/0015;
(Continued)

(56) References Cited

U.S. PATENT DOCUMENTS

2005/0247349 A1 11/2005 Barrows
2014/0182625 A1* 7/2014 Lee ..... A47L 15/4221 134/18

(Continued)

FOREIGN PATENT DOCUMENTS

EP 2510864 A1 10/2012
KR 20100020789 A1 2/2010

(Continued)

OTHER PUBLICATIONS

International Search Report and Written Opinion in International Application No. PCT/KR2018/000926, dated Apr. 24, 2018, 10 pages.

(Continued)

*Primary Examiner* — Benjamin L Osterhout
(74) *Attorney, Agent, or Firm* — Fish & Richardson P.C.

(57) ABSTRACT

A dishwasher includes a tub, a spray arm, a sump, a pump body, the pump body including a partition between first and second chambers, a communication hole in the partition that communicates with the first and second chambers, a pump flow path that connects the sump to the first chamber, an arm flow path that connects the spray arm to the second chamber, an impeller in the second chamber, a heating unit to heat water in the first chamber, a steam flow path that connects the first chamber to the tub, a connection flow path that connects the steam flow path to the arm flow path, and a flow path valve configured to close the steam flow path based on water being supplied to the connection flow path, and to open the steam flow path based on a lack of water being supplied to the connection flow path.

17 Claims, 3 Drawing Sheets

(52) U.S. Cl.
CPC ..... *A47L 15/4221* (2013.01); *A47L 15/4225* (2013.01); *A47L 15/4234* (2013.01); *A47L 2501/03* (2013.01); *A47L 2501/04* (2013.01); *A47L 2601/02* (2013.01); *A47L 2601/04* (2013.01)

(58) Field of Classification Search
CPC .. A47L 15/08; A47L 2501/03; A47L 2501/04; A47L 2601/02; A47L 2601/04
See application file for complete search history.

(56) References Cited

U.S. PATENT DOCUMENTS

| | | | | |
|---|---|---|---|---|
| 2017/0188781 | A1* | 7/2017 | Lee | A47L 15/4234 |
| 2017/0188784 | A1* | 7/2017 | Cho | A47L 15/4244 |
| 2017/0188785 | A1* | 7/2017 | Park | E05C 19/02 |
| 2017/0196432 | A1* | 7/2017 | Kim | A47L 15/4289 |
| 2017/0275927 | A1* | 9/2017 | Park | A47L 15/4259 |
| 2018/0110397 | A1* | 4/2018 | Kim | A47L 15/4278 |
| 2018/0184880 | A1* | 7/2018 | Lee | A47L 15/23 |

FOREIGN PATENT DOCUMENTS

| | | | |
|---|---|---|---|
| KR | 1202062 | A1 | 11/2012 |
| KR | 20130070275 | A1 | 6/2013 |
| KR | 20130071355 | A1 | 6/2013 |
| KR | 1678442 | A1 | 12/2016 |
| WO | WO2016028049 | A1 | 2/2016 |
| WO | WO2017022985 | A1 | 2/2017 |

OTHER PUBLICATIONS

Extended European Search Report in European Application No. 18153138.5, dated May 30, 2018, 9 pages.

* cited by examiner

【Figure 1】
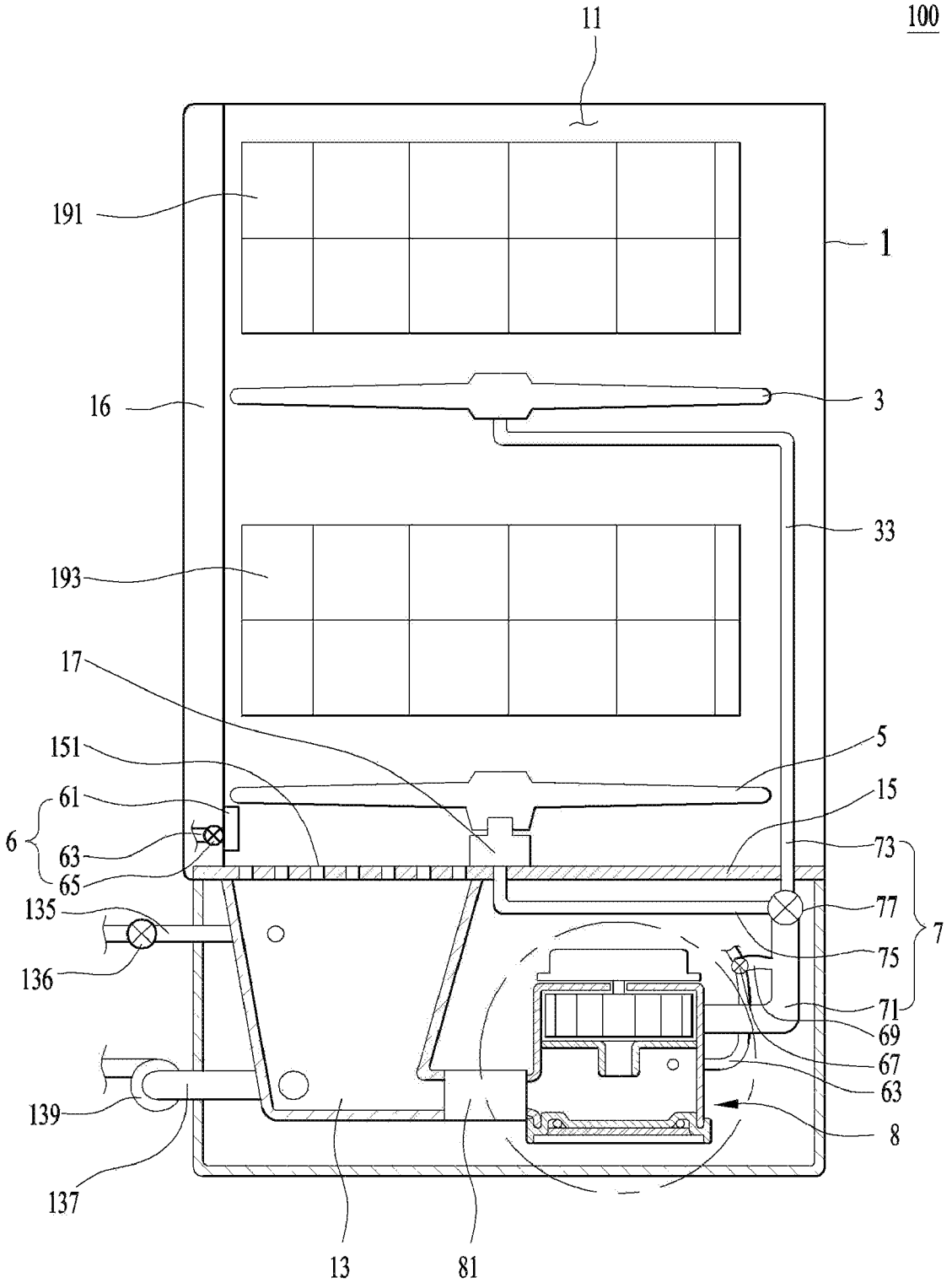

【Figure 2】
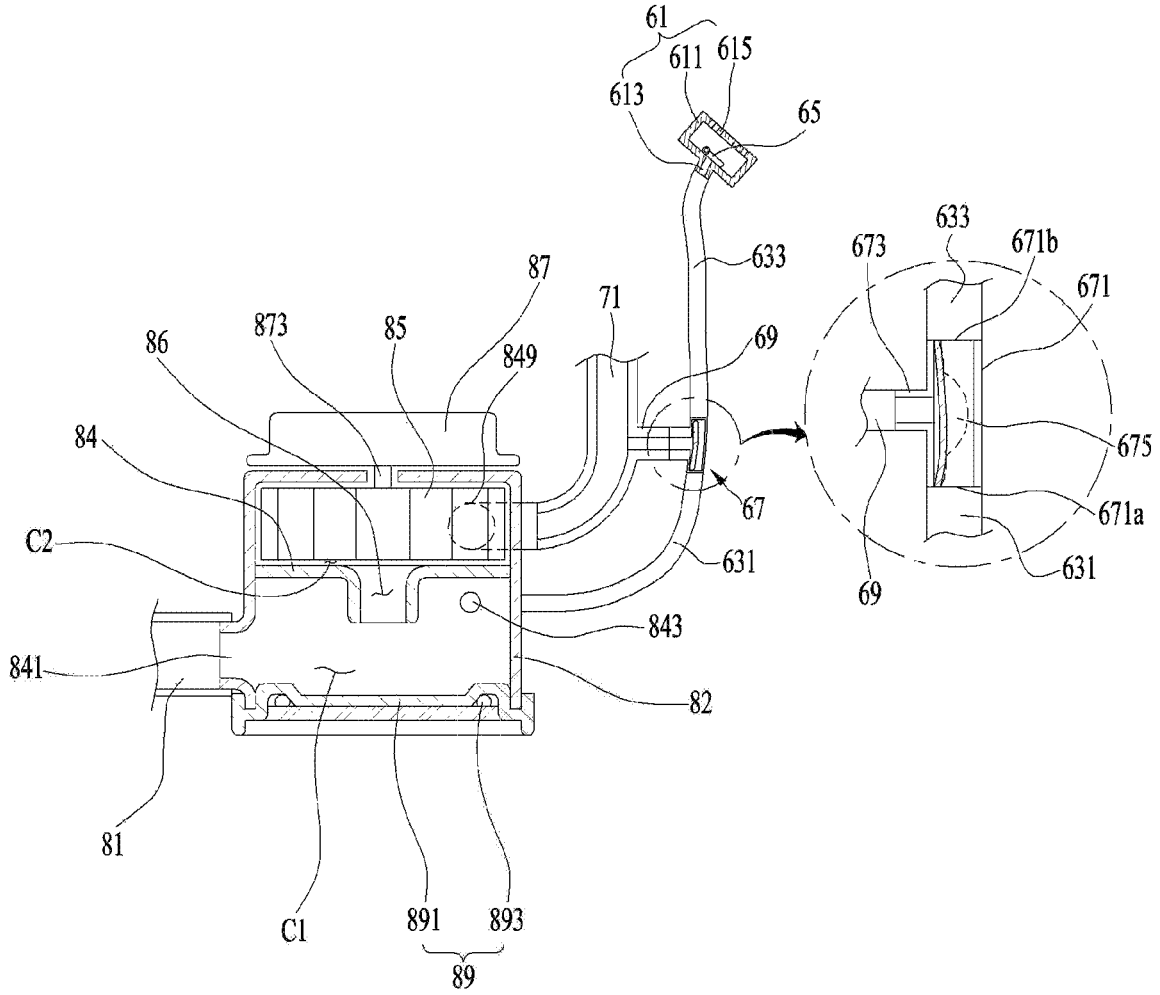

【Figure 3】
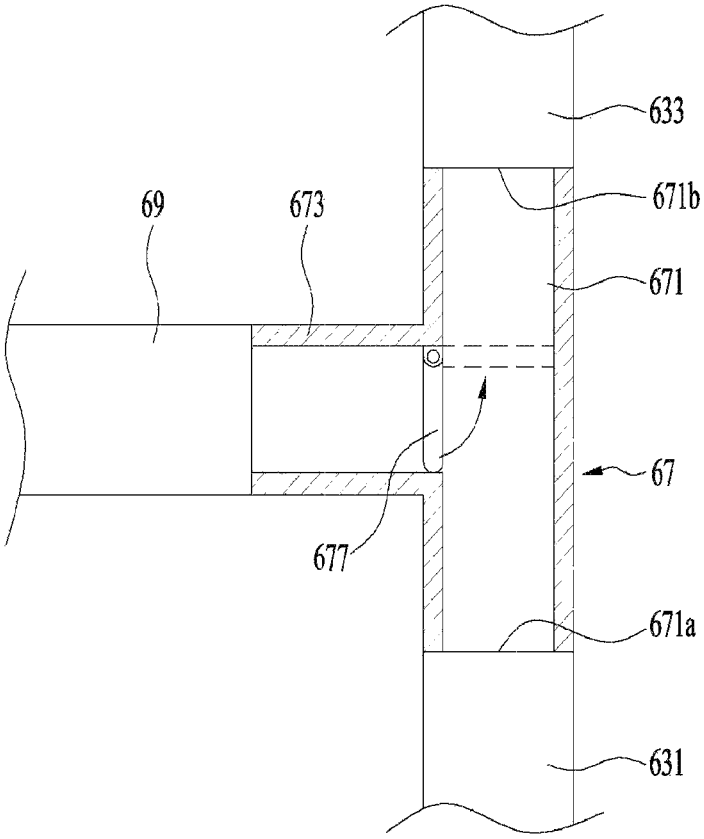

DISHWASHER

TECHNICAL FIELD

The present invention relates to a dishwasher.

BACKGROUND ART

A dishwasher is a home appliance that removes impurities remaining on a washing object by spraying water on the washing object. A conventional dishwasher generally includes a tub, which provides a washing space, a rack, which is provided in the tub to accommodate a washing object therein, a spray arm, which sprays water to the rack, a sump, which stores water therein, and a pump, which supplies the water stored in the sump to the spray arm.

Meanwhile, among conventional dishwashers, there is one capable of washing or sterilizing a washing object by supplying steam to the washing object. Among conventional dishwashers using steam, there is one having a heater provided inside a pump to heat water. In this case, the dishwasher essentially requires a steam flow path, which interconnects the inside of the pump and a tub. That is, the dishwasher having the heater provided inside the pump needs to have an arm flow path, which interconnects the pump and a spray arm, and the steam flow path, which interconnects the pump and the tub.

However, the dishwasher having the heater provided inside the pump functions to heat water or supply steam to the tub using the heater provided inside the pump, but causes deterioration in water pressure and noise when supplying water to the spray arm by operating the pump.

That is, since the pump moves water to the arm flow path via an impeller, which is rotatably provided inside a chamber in which water is stored, and the steam flow path is provided to interconnect the chamber and the tub, the air inside the tub may be introduced into the chamber through the steam flow path during rotation of the impeller. When the air is introduced into the chamber through the steam flow path, the pressure of water supplied to the spray arm through the arm flow path may be deteriorated, and noise may be generated during rotation of the impeller.

DISCLOSURE

Technical Problem

Therefore, it is one object of the present invention to provide a dishwasher having a pump capable of performing both a function of supplying steam to a washing object and a function of supplying water to the washing object.

In addition, it is another object of the present invention to provide a dishwasher capable of minimizing the generation of noise and deterioration in the pressure of water in a pump, which is capable of supplying steam and water to a washing object.

In addition, it is a further object of the present invention to provide a dishwasher in which a steam flow path, which supplies steam to a tub, and an arm flow path, which supplies water to a spray arm, are connected to a pump, the dishwasher being capable of preventing air from being introduced into the pump through the steam flow path when water is supplied to the spray arm.

Technical Solution

To achieve the objects described above, in accordance with one aspect of the present invention, there is provided a dishwasher including a tub configured to accommodate a washing object therein, a spray arm configured to spray water to the washing object, a sump configured to store water therein, a pump body including a first chamber and a second chamber separated from each other via a partition, a communication hole formed in the partition for communication between the first chamber and the second chamber, a pump flow path configured to interconnect the sump and the first chamber so as to guide the water stored in the sump to the first chamber, an arm flow path configured to interconnect an inside of the second chamber and the spray arm, an impeller rotatably provided inside the second chamber to supply the water to the arm flow path, a heating unit configured to heat the water stored inside the first chamber, a steam flow path configured to interconnect the first chamber and the tub, a connection flow path configured to interconnect the arm flow path and the steam flow path, and a flow path valve configured to close the steam flow path when the water is supplied to the connection flow path and to open the steam flow path when no water is supplied to the connection flow path.

The flow path valve may include an elastic piece configured to expand when the water is supplied through the connection flow path and to constrict by restoration force when no water is supplied through the connection flow path.

The elastic piece may be provided at a connection point of the steam flow path and the connection flow path.

The steam flow path may include a first steam flow path connected to the first chamber and a second steam flow path connected to the tub, and the flow path valve may include a body configured to interconnect the first steam flow path and the second steam flow path, an inlet port configured to connect the connection flow path to the body, and an elastic piece provided in the inlet port and configured to expand so as to interrupt connection between the first steam flow path and the second steam flow path when the water is supplied to the inlet port and to permit communication between the first steam flow path and the second steam flow path when no water is supplied to the inlet port.

The steam flow path may include a first steam flow path connected to the first chamber and a second steam flow path connected to the tub, and the flow path valve may include a body configured to interconnect the first steam flow path and the second steam flow path, an inlet port configured to connect the connection flow path to the body, and a rotating plate rotatably provided in the inlet port so as to interrupt connection between the first steam flow path and the second steam flow path when the water is supplied to the inlet port and to permit communication between the first steam flow path and the second steam flow path when no water is supplied to the inlet port.

The rotating plate may close the inlet port by a weight thereof when no water is supplied to the inlet port.

The dishwasher may further include a nozzle body fixed to an inner peripheral surface of the tub and connected to the steam flow path, a nozzle outlet port configured to discharge steam introduced into the nozzle body to an inside of the tub, and a nozzle valve provided in the nozzle body and configured to open the steam flow path when steam is supplied through the steam flow path and to close the steam flow path when no steam is supplied through the steam flow path.

The dishwasher may further include a nozzle body fixed to an inner peripheral surface of the tub and connected to the steam flow path, a nozzle outlet port configured to discharge steam introduced into the nozzle body to an inside of the tub, and a nozzle valve provided in the nozzle body and configured to open the nozzle outlet port when steam is supplied through the steam flow path and to close the nozzle outlet port when no steam is supplied through the steam flow path.

The dishwasher may further include a door configured to open or close the tub, and the nozzle body may be fixed to the door.

The heating unit may include a heat transfer portion configured to form a bottom surface of the first chamber and formed as a conductor, and a heater located outside the first chamber and configured to heat the heat transfer portion.

The first chamber may be located below the partition, and the second chamber may be located above the partition.

Advantageous Effects

The present invention has an effect of providing a dishwasher having a pump capable of performing both a function of supplying steam to a washing object and a function of supplying water to the washing object.

In addition, the present invention has an effect of providing a dishwasher capable of minimizing the generation of noise and deterioration in the pressure of water in a pump, which is capable of supplying steam and water to a washing object.

In addition, the present invention has an effect of providing a dishwasher in which a steam flow path, which supplies steam to a tub, and an arm flow path, which supplies water to a spray arm, are connected to a pump, the dishwasher being capable of preventing air from being introduced into the pump through the steam flow path when water is supplied to the spray arm.

DESCRIPTION OF DRAWINGS

The accompanying drawings, which are included to provide a further understanding of the invention, illustrate embodiments of the invention and together with the description serve to explain the principle of the invention.

In the drawings:

FIG. 1 illustrates an example of a dishwasher according to the present invention;

FIG. 2 illustrates an example of a pump according to the present invention; and FIG. 3 illustrates an example of a flow path valve according to the present invention.

BEST MODE

Hereinafter, exemplary embodiments of the present invention will be described in detail with reference to the accompanying drawings. A configuration or a control method of a device to be described below is merely given to describe the embodiments of the present invention, and is not intended to limit the scope of the present invention. The same reference numerals will be given to the same components throughout the specification.

As illustrated in FIG. 1, a dishwasher 100 may include a cabinet 1, a tub 11, which is provided inside the cabinet to provide a washing space therein, spray arms 3 and 5, which spray water to a washing object, and a pump 8, which supplies water to the spray arms.

A rack may be provided inside the tub 11 to accommodate the washing object therein. The rack may include an upper rack 191 provided in an upper region of the tub and a lower rack 193 provided in a lower region of the tub (below the upper rack).

The tub 11 is opened or closed by a door 16, which is provided on one surface of the cabinet. Thus, a user may open the tub 11 using the door 16, and then may discharge the racks 191 and 193 from the tub 11.

In the case in which the rack includes the upper rack 191 and the lower rack 193, the spray arms may include an upper arm 3, which sprays water to the upper rack 191, and a lower arm 5, which sprays water to the lower rack 193.

The water sprayed from the spray arms 3 and 5 to the washing object (i.e. the water remaining in the tub) may be collected in a sump 13.

The sump 13 is provided below the tub 11, and serves to store water therein. The sump 13 may be separated from the tub 11 via a sump cover 15. In this case, the sump cover 15 may have a collecting hole 151 for communication between the inside of the tub 11 and the inside of the sump 13.

Meanwhile, the sump 13 is connected to a water supply source (not illustrated) through a water supply flow path 135. The water supply flow path 135 may be opened or closed by a water supply valve 136, which is controlled by a controller (not illustrated).

The water stored in the sump 13 is discharged to the outside of the dishwasher through a drain flow path 137 and a drain pump 139.

The water stored in the sump 13 is supplied to the spray arms 3 and 5 via the pump 8 and an arm flow path 7. The arm flow path 7 may be configured with a first supply pipe 71, which is connected to the pump 8, a second supply pipe 73, which interconnects the first supply pipe 71 and the upper arm 3, and a third supply pipe 75, which interconnects the first supply pipe 71 and the lower arm 5.

The upper arm 3 may be rotatably coupled to the second supply pipe 73, and the lower arm 5 may be rotatably coupled to the third supply pipe 75.

The second supply pipe 73 and the third supply pipe 75 may be obtained by diverging the first supply pipe 71. In this case, a switching valve 77 may be provided at the divergent point of the second supply pipe 73 and the third supply pipe 75 to control the opening or closing of each supply pipe.

As illustrated in FIG. 2, the pump 8 includes a pump body 82, which is fixed inside the cabinet 1, a partition 84, which divides the space inside the pump body 82 to form a first chamber C1 and a second chamber C2 inside the pump body 82, a communication hole 86, which is formed in the partition 84 for communication between the first chamber C1 and the second chamber C2, and an impeller 85, which is rotatably provided inside the second chamber.

The first chamber C1 includes a pump inlet 841 formed in the pump body 82. The pump inlet 841 is connected to the sump 13 through a pump flow path 81. Thus, the first chamber C1 receives the water stored in the sump 13 through the pump flow path 81.

The second chamber C2 includes a pump outlet 849 formed in the pump body 82. The first supply pipe 71 is connected to the second chamber C2 via the pump outlet 849.

The impeller 85 is rotated by a motor 87, which is fixed on the upper surface of the pump body 82. A rotating shaft 873 of the motor penetrates the upper surface of the pump body, and is connected to the impeller 85.

Meanwhile, a heating unit 89 is provided in the bottom surface of the first chamber C1 of the pump. When the pump body 82 takes the form of a cylinder having an open lower side, the heating unit 89 may be provided so as to form the bottom surface of the first chamber C1.

In this case, the heating unit 89 may include a heat transfer portion 891, which forms the bottom surface of the first chamber C1, and a heater 893, which is located outside the first chamber C1 and fixed to the heat transfer portion. The heat transfer portion 891 may be formed of a metal that easily transfers heat.

Since the heating unit 89 is provided so as to form the bottom surface of the first chamber C1, the pump provided in the present invention is capable of performing both a function of supplying water to the spray arms 3 and 5 and a function of heating water.

In addition, the dishwasher 100 having the pump 8 described above may supply steam to the tub 11 via the heating unit 89 provided in the pump 8. To this end, the dishwasher 100 may further include a steam supply unit 6.

The steam supply unit 6 may include a nozzle 61, which sprays steam to the inside of the tub 11, and a steam flow path 63, which interconnects the nozzle 61 and the first chamber C1.

FIG. 1 illustrates an example of the case in which the nozzle 61 is provided in the door 16. In this case, the nozzle 61 may be fixed to the lower portion of the one surface of the door that forms the inner peripheral surface of the tub.

The dishwasher 100 having the above-described structure may cause deterioration in the pressure of water inside the first chamber C1 and the generation of noise when the impeller 85 is rotated via the motor 87. This is because the air inside the tub 11 may be introduced into the first chamber C1 through the steam supply unit 6 during rotation of the impeller 85.

In order to solve this problem, in the present invention, a connection flow path 69 may be provided to interconnect the arm flow path 7 and the steam flow path 63, and a flow path valve 67 may be provided to open or close the steam flow path 63 depending on whether or not water is supplied to the connection flow path 69.

The flow path valve 67 closes the steam flow path 63 when the impeller 85 is rotated and water is supplied to the connection flow path 69, and opens the steam flow path 63 when the operation of the impeller 85 is stopped and no water is supplied to the connection flow path 69. As an example, the flow path valve 67 illustrated in FIG. 2 includes an elastic piece 675 (e.g. a rubber plate), which expands to close the steam flow path 63 when water is supplied through the connection flow path 69, and constricts to open the steam flow path 63 when no water is supplied through the connection flow path 69. In this case, the elastic piece may be provided at the connection point of the steam flow path 63 and the connection flow path 69.

The steam flow path 63 may include a first steam flow path 631 connected to the first chamber C1 and a second steam flow path 633 connected to the tub via the nozzle 61. The flow path valve 67 may further include a body 671, which interconnects the first steam flow path 631 and the second steam flow path 633, and an inlet port 673, which connects the connection flow path 69 to the body 671. The elastic piece 675 may be located in the inlet port 673.

The body 671 has a body introduction hole 671*a* to which the first steam flow path 631 is fixed and a body discharge hole 671*b* to which the second steam flow path 633 is fixed. The steam introduced into the body 671 through the body introduction hole 671*a* moves to the second steam flow path 633 through the body discharge hole 671*b*.

Thus, when water is supplied to the inlet port 673 via rotation of the impeller, the elastic piece 675 expands to interrupt the connection of the first steam flow path 631 and the second steam flow path 633 (refer to the dotted line). When the rotation of the impeller is stopped and no water is supplied to the inlet port 673, the elastic piece 675 constricts to permit communication between the first steam flow path 631 and the second steam flow path 633.

The flow path valve 67 having the above-described structure may prevent the air inside the tub 11 from being introduced into the first chamber C1 through the steam flow path 63 because it closes the steam flow path 63 when the impeller 85 is rotated. Thus, the present invention may minimize deterioration in the pressure of water in the pump 8 and the generation of noise by preventing the air inside the tub from being introduced into the first chamber C1 through the steam flow path 63 when the pump 8, which implements a function of generating steam and a function of supplying water to a washing object, is operated.

FIG. 3 illustrates another embodiment of the flow path valve 67. The flow path valve 67 according to the present embodiment includes the body 671, which interconnects the first steam flow path 631 and the second steam flow path 633, the inlet port 673, which connects the connection flow path 69 to the body 671, and a rotating plate 677, which is rotatably provided in the inlet port 673.

The rotating plate 677 interrupts the connection of the first steam flow path 631 and the second steam flow path 633 when water is supplied to the inlet port 673, and permits communication between the first steam flow path 631 and the second steam flow path 633 when no water is supplied to the inlet port 673.

The rotating plate 677 is rotatably provided in the inlet port 673 so as to close the inlet port by the weight thereof when no water is supplied to the inlet port 673 (or so as to open the body introduction hole and the body discharge hole formed in the body). That is, the rotating plate 677 may be rotatably fixed in the upper region of the inlet port 673.

In order to more assuredly prevent the air inside the tub from being introduced into the first chamber C1 when the impeller 85 is rotated, the dishwasher of the present invention may further include a nozzle valve 65 for opening or closing the nozzle 61.

As illustrated in FIG. 2, the nozzle 61 may include a nozzle body 611, which is fixed to the one surface of the door 16 that forms the inner peripheral surface of the tub 11, a nozzle inlet port 613, which interconnects the nozzle body 611 and the steam flow path 63 so that steam is supplied into the nozzle body, and a nozzle outlet port 615, which discharges the steam introduced into the nozzle body 611 to the tub 11.

In this case, the nozzle valve 65 may be provided in the nozzle body 611 so as to open the steam flow path 63 when steam is supplied through the steam flow path 63 and to close the steam flow path 63 when no steam is supplied through the steam flow path 63.

Alternatively, the nozzle valve 65 may be configured to open or close the nozzle outlet port 615 depending on whether or not steam is supplied into the nozzle body 611. That is, the nozzle valve 65 may open the nozzle outlet port 615 when steam is supplied into the nozzle body 611, and may close the nozzle outlet port 615 when no steam is supplied to the nozzle body 611.

The present invention may be modified and implemented in various forms and the scope of the present invention is not limited to the above-described embodiments. Thus, modifications of the embodiments should be interpreted as being included in the scope of the present invention so long as they include components defined by the following claims.

What is claimed is:

1. A dishwasher comprising:

a tub configured to accommodate an object to be washed;

a spray arm located in the tub and configured to spray water to the object;

a sump configured to store water;

a pump body connected to the sump, the pump body comprising a partition that partitions the pump body into a first chamber and a second chamber;

a communication hole defined in the partition and configured to communicate with the first chamber and the second chamber;

a pump flow path that connects the sump to the first chamber and that is configured to guide water from the sump to the first chamber;

an arm flow path that connects the spray arm to an inside of the second chamber;

an impeller located within the second chamber and configured to rotate to supply water to the arm flow path;

a heating unit configured to heat water stored in the first chamber;

a steam flow path that connects the first chamber to the tub;

a connection flow path that connects the steam flow path to the arm flow path; and a flow path valve configured to:

close the steam flow path based on water being supplied to the connection flow path, and open the steam flow path based on a lack of water being supplied to the connection flow path.

2. The dishwasher according to claim 1, wherein the flow path valve comprises an elastic part that is configured to:

expand toward an inner surface of the steam flow path based on water being supplied through the connection flow path; and shrink away from the inner surface of the steam flow path based on a lack of water being supplied through the connection flow path.

3. The dishwasher according to claim 2, wherein the elastic part is located at a connection point at which the connection flow path is connected to the steam flow path.

4. The dishwasher according to claim 3, wherein the elastic part includes a surface that is configured to contact an inner surface of the steam flow path based on expansion of the elastic part.

5. The dishwasher according to claim 1, wherein the steam flow path comprises a first steam flow path connected to the first chamber, and a second steam flow path connected to the tub, and wherein the flow path valve comprises:

a body configured to connect the first steam flow path to the second steam flow path;

an inlet port configured to connect the connection flow path to the body; and an elastic part located in the inlet port and configured to:

expand to interrupt connection between the first steam flow path and the second steam flow path based on water being supplied to the inlet port, and allow communication between the first steam flow path and the second steam flow path based on a lack of water being supplied to the inlet port.

6. The dishwasher according to claim 5, wherein the inlet port is located between the first steam flow path and the second steam flow path.

7. The dishwasher according to claim 1, wherein the steam flow path comprises a first steam flow path connected to the first chamber, and a second steam flow path connected to the tub, and wherein the flow path valve comprises:

a body configured to connect the first steam flow path to the second steam flow path;

an inlet port configured to connect the connection flow path to the body; and a rotating plate located in the inlet port and configured to:

rotate in a first direction to interrupt connection between the first steam flow path and the second steam flow path based on water being supplied to the inlet port, and rotate in a second direction to allow communication between the first steam flow path and the second steam flow path based on a lack of water being supplied to the inlet port.

8. The dishwasher according to claim 7, wherein the inlet port includes a shaft located at an inner surface of the inlet port and rotatably coupled to a first end of the rotating plate.

9. The dishwasher according to claim 8, wherein the rotating plate includes a second end that is configured to:

contact an inner surface of at least one of the first steam flow path or the second steam flow path based on water being supplied to the inlet port; and contact the inner surface of the inlet port based on a lack of water being supplied to the inlet port.

10. The dishwasher according to claim 7, wherein the rotating plate is further configured to rotate in the second direction by a weight of the rotating plate to close the inlet port based on a lack of water being supplied to the inlet port.

11. The dishwasher according to claim 1, further comprising:

a nozzle body coupled to an inner peripheral surface of the tub and connected to the steam flow path, the nozzle body being configured to receive steam from the steam flow path;

a nozzle outlet port configured to discharge steam from the nozzle body to an inside of the tub; and a nozzle valve located in the nozzle body and configured to:

open the steam flow path based on steam being supplied through the steam flow path, and close the steam flow path based on a lack of steam being supplied through the steam flow path.

12. The dishwasher according to claim 1, further comprising:

a nozzle body coupled to an inner peripheral surface of the tub and connected to the steam flow path, the nozzle body being configured to receive steam from the steam flow path;

a nozzle outlet port configured to discharge steam from the nozzle body to an inside of the tub; and a nozzle valve located in the nozzle body and configured to:

open the nozzle outlet port based on steam being supplied through the steam flow path, and close the nozzle outlet port based on a lack of steam being supplied through the steam flow path.

13. The dishwasher according to claim 11, further comprising a door configured to open or close at least a portion of the tub, wherein the nozzle body is coupled to the door.

14. The dishwasher according to claim 12, further comprising a door configured to open or close at least a portion of the tub, wherein the nozzle body is coupled to the door.

15. The dishwasher according to claim 1, wherein the heating unit comprises:

a heat transfer portion that defines a bottom surface of the first chamber, the heat transfer portion comprising a conductor; and a heater located outside of the first chamber and configured to provide heat to the heat transfer portion.

16. The dishwasher according to claim 1, wherein the first chamber is located vertically below the partition, and the second chamber is located vertically above the partition.

17. The dishwasher according to claim 16, wherein the flow path valve is located vertically above the second chamber.

* * * * *